United States Patent [19]

Todisco

[11] Patent Number: 4,525,235

[45] Date of Patent: Jun. 25, 1985

[54] PAPER AND TAPE DISPENSING APPARATUS

[75] Inventor: Joseph Todisco, Woburn, Mass.

[73] Assignee: Marson Corporation, Chelsea, Mass.

[21] Appl. No.: 640,735

[22] Filed: Aug. 14, 1984

[51] Int. Cl.[3] ..... B31F 5/06; B32B 31/18

[52] U.S. Cl. ..... 156/511; 156/516; 156/554; 156/579; 225/38

[58] Field of Search ..... 156/511, 516, 527, 554, 156/576, 579; 225/34, 38

[56] References Cited

U.S. PATENT DOCUMENTS

| | | | |
|---|---|---|---|
| 3,553,060 | 1/1971 | Waltz | 156/554 |
| 3,847,709 | 11/1974 | Martin | 156/554 |
| 4,052,248 | 10/1977 | Hunter | 156/554 |
| 4,426,245 | 1/1984 | Driscoll et al. | 156/554 |
| 4,470,870 | 9/1984 | Driscoll et al. | 156/554 |

*Primary Examiner*—Michael Wityshyn

*Attorney, Agent, or Firm*—Pennie & Edmonds

[57] ABSTRACT

A portable paper and tape dispensing apparatus accessible from at least two sides including dispensing stations capable of ready conversion to permit dispensing to either side. Each dispensing station is capable of uniting the paper and tape in a selected fashion prior to its exiting from the station.

5 Claims, 7 Drawing Figures

17
20
29
20b
24L
33
B
20a
4
26
41
A
3
20d
20c
20f
20e
36
24R
37
18
10
21c
37
36
18
21a
33
21
21b
B
11
22
22d
22f
22c
36
22b
22h
22a
18
41
16
A
15
23
23c
23d
29
23e
23b
36
24L
24R
33
23a
18
13
12

PAPER AND TAPE DISPENSING APPARATUS

BACKGROUND OF THE INVENTION

Apparatus for dispensing paper and tape have been disclosed in numerous prior patents (U.S. Pat. Nos. 3,152,032; 3,463,694; 3,553,060; 3,630,421; 3,787,271; and Re. 23,542). Other apparatus have been disclosed which permit ready substitution of paper rolls on cantilevered arms (see U.S. Pat. Nos. 3,847,709 and 4,052,248).

None of the prior apparatus has simplicity of construction and assembly capable of versatile dispensing and accomplished proper tape to paper union prior to exiting from the dispensing apparatus.

SUMMARY OF THE INVENTION

Broadly, the present invention is an apparatus for dispensing a paper-tape composite such apparatus having a frame, a dispensing unit secured to the frame, a pair of spaced-apart projections on the dispensing unit which projections are capable of detachably receiving and supporting either a roll of paper or a cutter and paper support element. Mounted between the projections is a tape dispenser orientable to feed the tape toward the projection having the paper roll on it.

It is a feature of the apparatus that one or more dispensing units may be mounted on the apparatus to permit withdrawal of the paper-tape composite from either side of the apparatus.

DESCRIPTION OF THE PREFERRED EMBODIMENT

Figure 1:
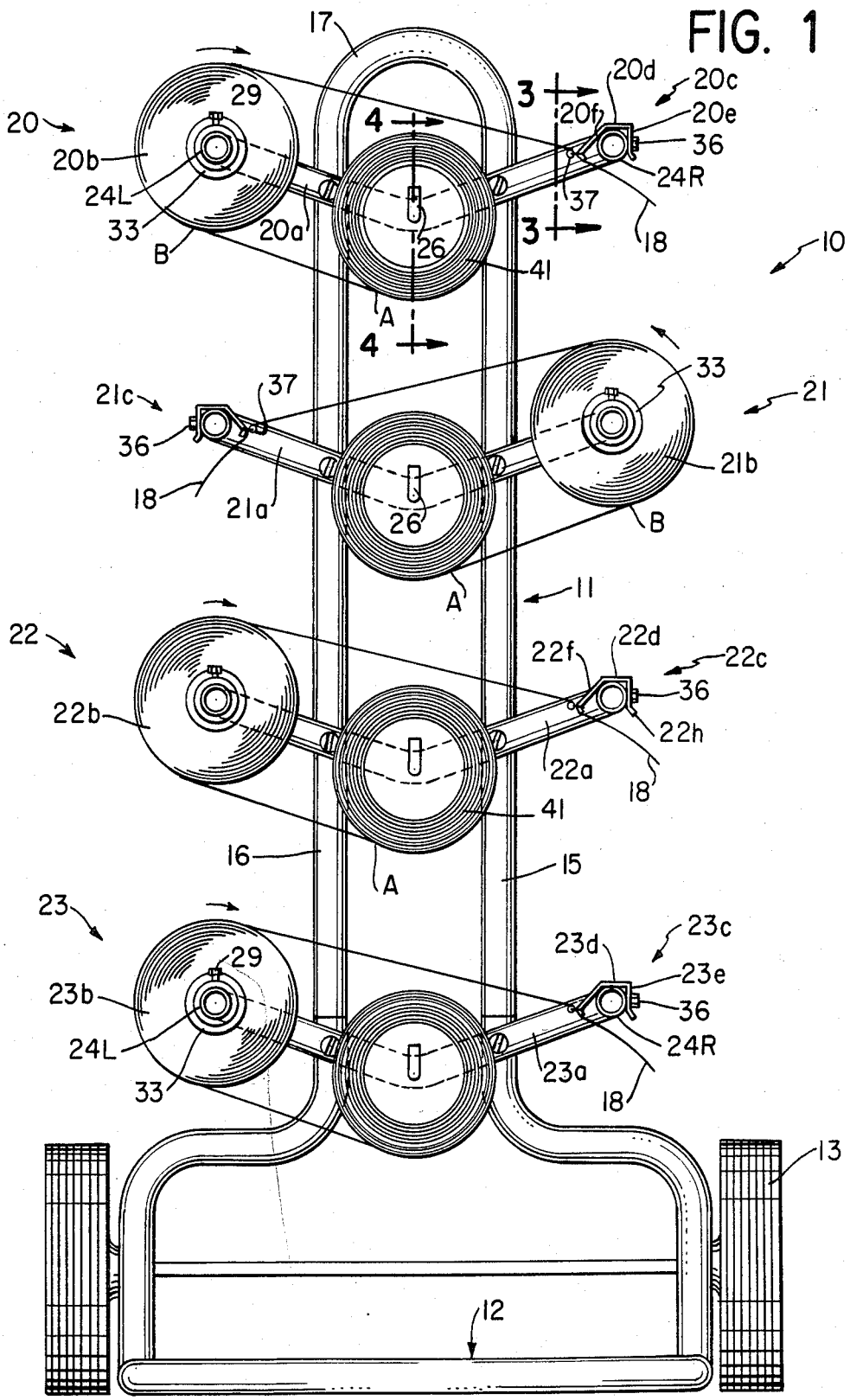
FIG. 1 is a view taken along and in the direction of the FIG. 1 arrow of FIG. 2.
Figure 2:
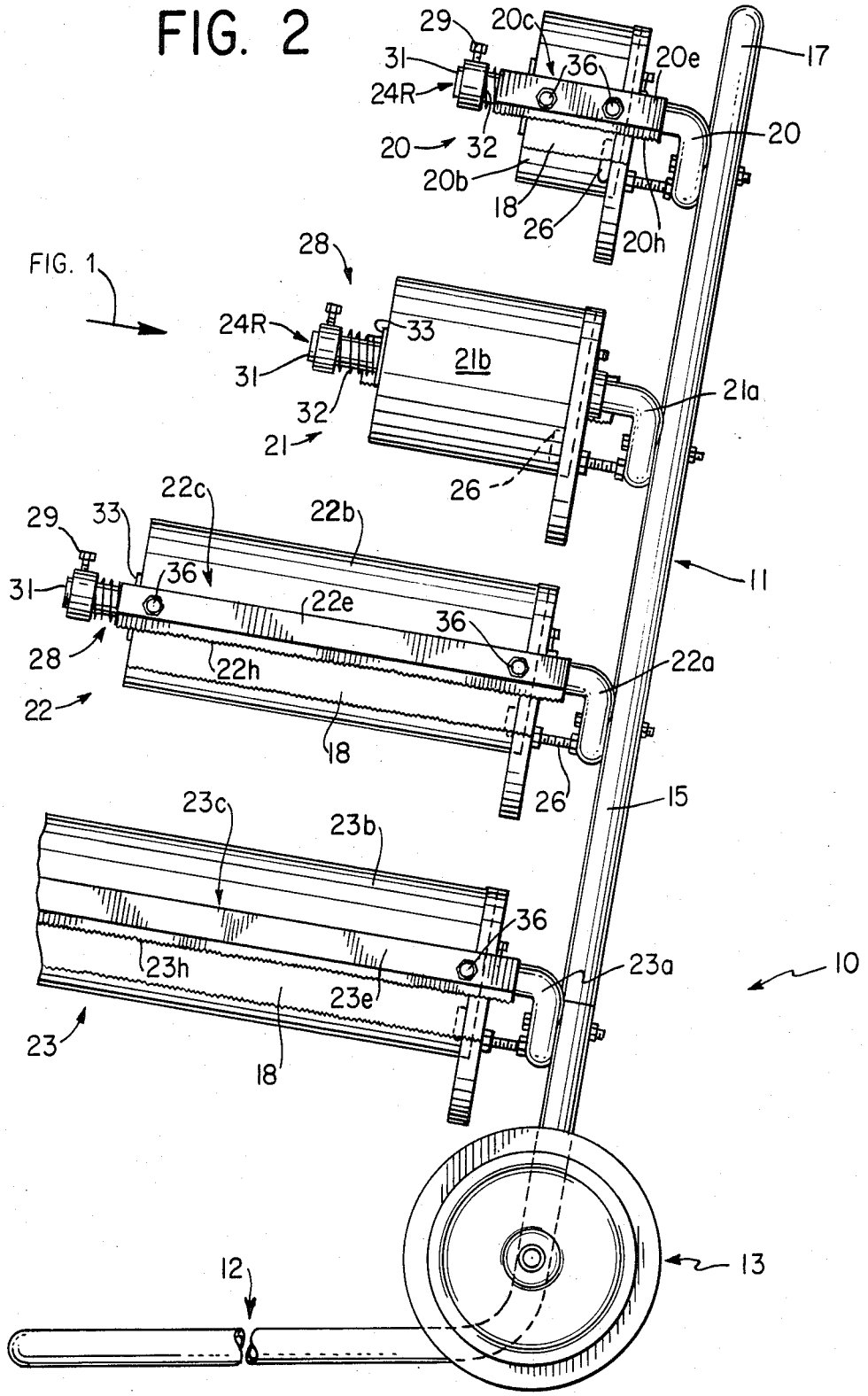
FIG. 2 is a side elevational view of an embodiment of the invention.

Referring to FIGS. 1 and 2, wheeled multiple dispensing apparatus 10 includes vertical frame 11; lower stand frame element 12 and wheel and axle set 13 which rest on a support floor. Vertical frame 11 is formed in an elongated U-shape consisting of two generally parallel uprights 15, 16 and a curved piece 17 which functions as a handle. Uprights 15, 16 and curved piece 17 are integrally formed.

Figure 4:
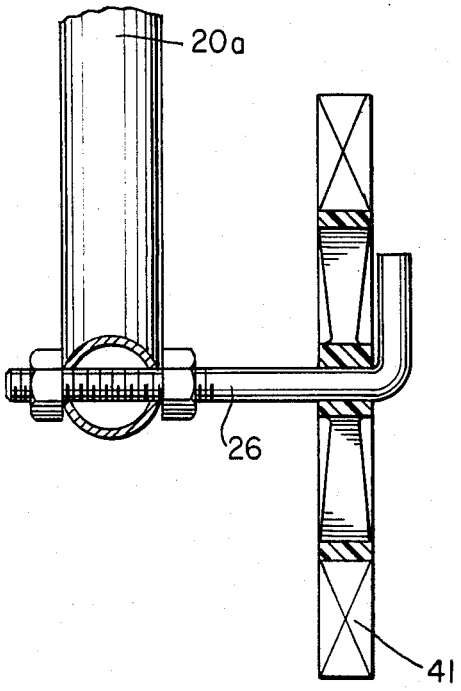
FIG. 4 is a sectional view taken along line 4—4 of FIG. 1.
Figure 5:
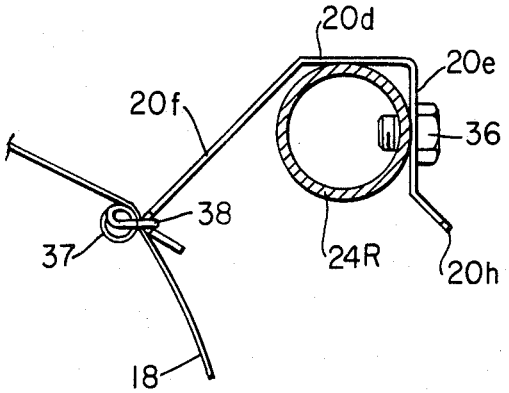
FIG. 5 is a sectional view taken along line 5—5 of FIG. 3.

Supported on vertical frame 11 are a plurality of individual dispensing units 20, 21, 22, and 23. Each such unit includes a V-shaped mount arm 20*a*, 21*a*, 22*a*, and 23*a*; two stationary support projections 24R and 24L; and a central tape support axle 26 (see also FIG. 4). Support projections 24R, 24L are positioned at approximately equal vertical heights for supporting either a rotatable paper roll 20*b*, 21*b*, 22*b* and 23*b* or a cutter and paper sheet support housing 20*c*, 21*c*, 22*c*, and 23*c*. Each stationary projection 24R, 24L is of a different length to serve paper rolls and support housings of differing widths (see FIG. 2).

Each dispensing unit 20, 21, 22, 23 is capable of carrying the roll of paper on either its right or its left projection 24R, 24L with its sheet support housing 20*c* (etc.) on the other projection. This permits withdrawing the end of paper sheet 18 from one or more rolls from either side of the apparatus 10.

Each projection 24R, 24L is positioned at an angle to the horizontal thus employing the force of gravity to assist in retaining the paper rolls 20*b* (etc.) on the projections. Removable frictional drag mechanisms 28 are attached through set screws 29 to the projection end portion 31 after a roll has been placed in operative position. The frictional drag mechanisms 28 operate by urging coil springs 32 against the roll end 33 to slow and stop roll rotation. This prevents the rolls, which have substantial weight and inertia, from continuing to rotate any substantial amount after the operator stops pulling on paper sheet 18.

Cutter and paper sheet support housings 20*c*, 21*c*, 22*c* and 23*c* include a top panel 20*d*, 21*d*, 22*d*, 23*d*; depending outside panel 20*e*, 21*e*, 22*e* and 23*e* and depending angled inside panel 20*f*, 21*f*, 22*f* and 23*f*. Each outside panel has holes 34 to receive threaded bolts 36 for bolting the panels to the projections. Each sheet support housing 20*c*, 21*c*, 22*c* and 23*c* is readily movable from the projection 24L, 24R to another by unbolting and rebolting.

Figure 3:
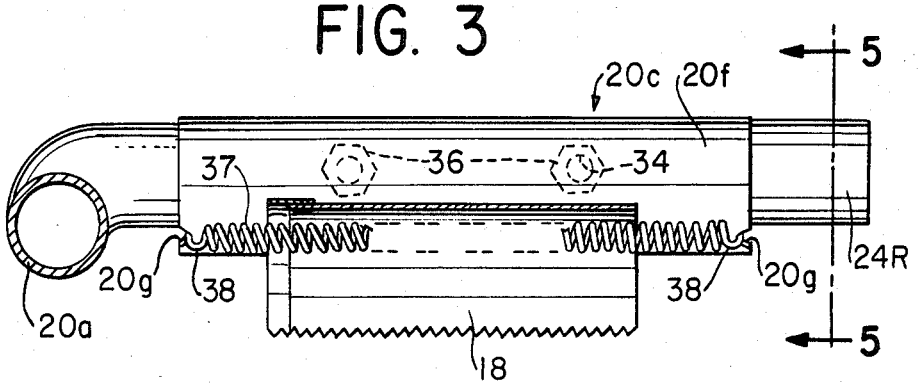
FIG. 3 is a sectional view taken along line 3—3 of FIG. 1.

Turning to FIG. 3, each side panel 20*f* (etc.) carries an extendible resilient sheet holder 37 which holder is connected to the ends of the panel by hooks 38. Indentations 20*g*, 21*g*, 22*g* and 23*g* in the inside panels at each end cradle the sheet holder hooks 38 to prevent them from moving out of position under action of sheet 18. Cutter outside panels 20*e* (etc.) carry serrated cutter edges 20*h*, 21*h*, 22*h* and 23*h* against which sheet 18 is pulled to tear off a selected length of the sheet.

Turning back to FIG. 1, tape application is accomplished by initially positioning the end of the tape as unrolled from a tape roll 41 from point A near the bottom of tape roll 40 to a point B on the paper roll 20*b* (etc.). The tape is then brought around the roll of paper 20*b* (etc.) and adhered to the top of the lead sheet 18. The pulling of sheet 18 will thereafter cause the tape to be unwound from tape roll 41 as selected amounts of paper are removed and cut off. The tape support axle 26 is shaped to support tape roll 41 to dispense to the left or, upon turning the roll 180°, to dispense to the right.

Figure 6:
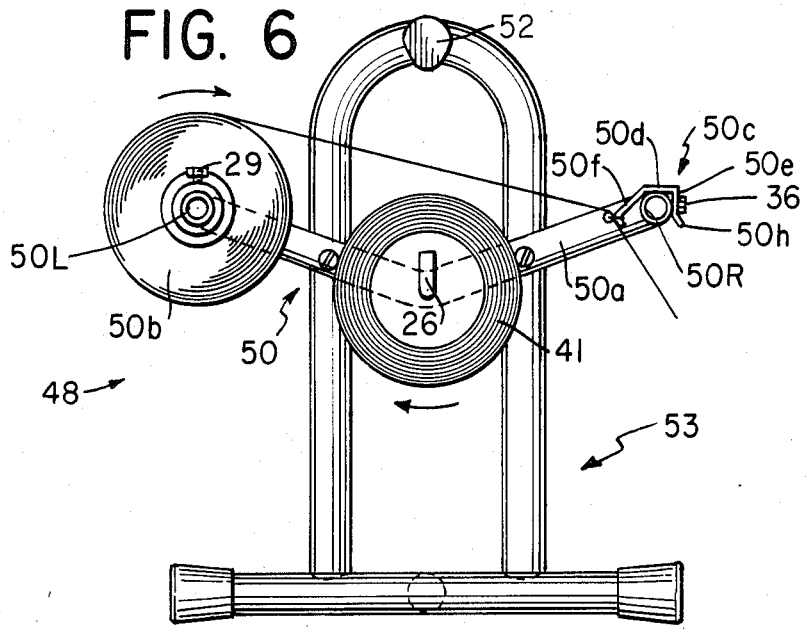
FIG. 6 is a view taken along and in the direction of the FIG. 6 arrow of FIG. 7.
Figure 7:
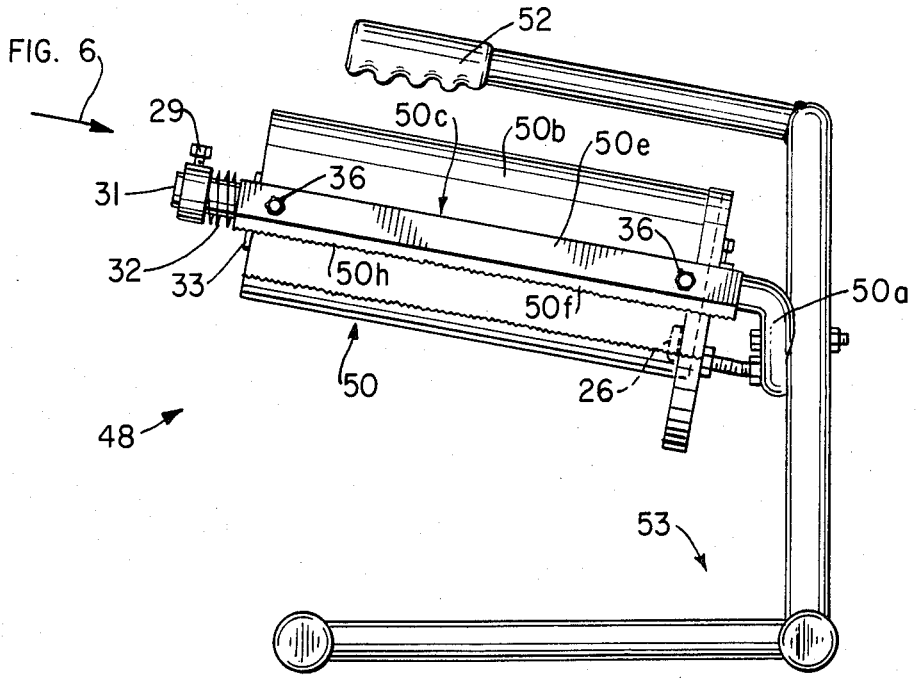
FIG. 7 is a side elevational view of an alternative embodiment of the apparatus.

Turning to FIG. 6, a tabletop apparatus 48 carrying one dispensing unit 50 is shown which unit is constructed the same as those previously described above including a V-shaped mount arm 50*a*; a pair of projections 50R, 50L; a paper roll 50*b*; and a sheet support housing 50*c* having a top panel 50*d*; an outside panel 50*e*; inside panel 50*f*; and cutter edge 50*h*. Apparatus 48 has a stand 53 and is readily portable using handle 52.

In the operation of each dispensing apparatus of this invention, a roll of paper 20*b* (etc.) or 50*b* having a selected width is positioned on one of the projections 24, 50 depending on the side from which the paper sheet is desired to be dispensed. The cutter support housing 20*c* (etc.) or 50*c* is positioned by bolting on the opposite projection arm. A tape roll 41 is positioned on tape support axle 26 with the lead section of tape exiting tape roll 41 from the bottom of the roll. The lead section of tape is passed under the paper roll 20*b* (etc. or 50*b* and positioned on the edge of the lead section of paper 18.

As the lead section 18 is pulled the tension in the tape and the force required to pull the paper causes the tape to be firmly united to the paper. The thus-formed paper-tape composite is then threaded between inside panel 20*f* (50*f*) and sheet holder 37 to support the composite paper-tape. When a length of composite paper-tape is desired, it is withdrawn and then raised up and cut off by manipulating it over cutter edge 20*h*, (etc.) or 50*h*.

I claim:

1. An apparatus for dispensing both paper from a roll and tape from a roll to form a paper tape composite which apparatus has a roll of paper and a cutter and paper support comprising (a) a vertically-oriented frame means positioned on a support surface;

(b) a dispensing unit mounted on the frame means which unit in turn comprises a pair of spaced-apart projections extending from the frame; each projection being capable of removably receiving a roll of paper or a cutter and paper support means;

a cutter and paper support means attached to one of the projections;

a roll of paper on the other projection; and a tape roll axle means positioned between such projections for mounting a tape roll thereon to feed tape from the tape roll toward either projection.

2. The apparatus of claim 1 having two such dispensing units mounted on the frame one above the other with one unit having a paper roll and tape roll mounted to dispense a paper-tape composite to one side of the apparatus and with the other unit has a paper roll and tape roll to dispense such a composite to the other side.

3. The apparatus of claim 1 in which the cutter and paper support means includes elongated resilient paper sheet support means.

4. The apparatus of claim 1 in which the spaced-apart projections are mounted substantially the same distance above the support surface.

5. The apparatus of claim 1 in which a frictional drag element is removably mountable on such projections to reduce rotation of the roll following the pulling on the lead paper sheet section from the paper roll.

* * * * *